US011308901B2

(12) United States Patent
Kang

(10) Patent No.: US 11,308,901 B2
(45) Date of Patent: Apr. 19, 2022

(54) PIXEL DRIVING METHOD, PIXEL DRIVING APPARATUS AND COMPUTER DEVICE

(71) Applicant: HKC CORPORATION LIMITED, Shenzhen (CN)

(72) Inventor: Chih Tsung Kang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/273,299

(22) PCT Filed: Dec. 17, 2018

(86) PCT No.: PCT/CN2018/121540
§ 371 (c)(1),
(2) Date: Mar. 3, 2021

(87) PCT Pub. No.: WO2020/103244
PCT Pub. Date: May 28, 2020

(65) Prior Publication Data

US 2021/0327375 A1 Oct. 21, 2021

(30) Foreign Application Priority Data

Nov. 20, 2018 (CN) ..... 201811383608.1

(51) Int. Cl.
*G09G 3/36* (2006.01)

(52) U.S. Cl.
CPC ... *G09G 3/3607* (2013.01); *G09G 2300/0452* (2013.01); *G09G 2310/027* (2013.01)

(58) Field of Classification Search
CPC ..... G09G 3/3607; G09G 2300/0452; G09G 2310/027
See application file for complete search history.

(56) References Cited

U.S. PATENT DOCUMENTS

2018/0254020 A1 9/2018 Buckley et al.

FOREIGN PATENT DOCUMENTS

CN 101523478 A 9/2009
CN i106683627 A 5/2017
(Continued)

OTHER PUBLICATIONS

Hailiang Peng, the International Searching Authority written comments, dated Aug. 2019, CN.
(Continued)

*Primary Examiner* — Kenneth B Lee, Jr.

(57) ABSTRACT

A pixel driving method is provided. The method includes: acquiring an average pixel signal of sub-pixels of each color in each unit pixel in a pixel block, where the unit pixel includes a red sub-pixel, a green sub-pixel and a blue sub-pixel; acquiring a color signal of the pixel block according to the average pixel signal of the sub-pixels of each color; determining a color that the pixel block deflects to during display according to the color signal and a preset main color-rendering determination condition, and loading first-type gray-scale signals to a part of same-color sub-pixels in the pixel block and loading second-type gray-scale signals to the remaining same-color sub-pixels based on a preset rule according to the determination result, where the first-type gray-scale signals are not equal to the corresponding second-type gray-scale signals.

16 Claims, 9 Drawing Sheets

(56) References Cited

FOREIGN PATENT DOCUMENTS

| | | | | | |
|---|---|---|---|---|---|
| CN | 106981275 | A | | 7/2017 | |
| CN | 107154240 | A | * | 9/2017 | ..... G09G 3/3607 |
| CN | 107154240 | A | | 9/2017 | |
| CN | 107256899 | A | | 10/2017 | |
| CN | 107301851 | A | | 10/2017 | |

OTHER PUBLICATIONS

Hailiang Peng the International Searching Report, dated 2019, CN.

* cited by examiner

| R | RH | RL |
|---|---|---|
| 0 | RH0 | RL0 |
| 1 | RH1 | RL1 |
| 2 | RH2 | RL2 |
| 3 | RH3 | RL3 |
| 4 | RH4 | RL4 |
| 5 | RH5 | RL5 |
| ⋮ | ⋮ | ⋮ |
| 50 | RH50 | RL50 |
| 51 | RH51 | RL51 |
| 52 | RH52 | RL52 |
| ⋮ | ⋮ | ⋮ |
| 253 | RH253 | RL253 |
| 254 | RH254 | RL254 |
| 255 | RH255 | RL255 |

Rave-1

Rave-i

| Rave | RH | RL |
|---|---|---|
| 0 | RH0 | RL0 |
| 1 | RH1 | RL1 |
| 2 | RH2 | RL2 |
| 3 | RH3 | RL3 |
| 4 | RH4 | RL4 |
| 5 | RH5 | RL5 |
| ⋮ | ⋮ | ⋮ |
| 50 | RH50 | RL50 |
| 51 | RH51 | RL51 |
| 52 | RH52 | RL52 |
| ⋮ | ⋮ | ⋮ |
| 253 | RH253 | RL253 |
| 254 | RH254 | RL254 |
| 255 | RH255 | RL255 |

Gave-1

Gave-j

| Gave | GH | GL |
|---|---|---|
| 0 | GH0 | GL0 |
| 1 | GH1 | GL1 |
| 2 | GH2 | GL2 |
| 3 | GH3 | GL3 |
| 4 | GH4 | GL4 |
| 5 | GH5 | GL5 |
| ⋮ | ⋮ | ⋮ |
| 50 | GH50 | GL50 |
| 51 | GH51 | GL51 |
| 52 | GH52 | GL52 |
| ⋮ | ⋮ | ⋮ |
| 253 | GH253 | GL253 |
| 254 | GH254 | GL254 |
| 255 | GH255 | GL255 |

FIG. 6

Rave-1

Rave-i

| R' ave | RH' | RL' |
|---|---|---|
| 0 | RH' 0 | RL' 0 |
| 1 | RH' 1 | RL' 1 |
| 2 | RH' 2 | RL' 2 |
| 3 | RH' 3 | RL' 3 |
| 4 | RH' 4 | RL' 4 |
| 5 | RH' 5 | RL' 5 |
| ⋮ | ⋮ | ⋮ |
| 50 | RH' 50 | RL' 50 |
| 51 | RH' 51 | RL' 51 |
| 52 | RH' 52 | RL' 52 |
| ⋮ | ⋮ | ⋮ |
| 243 | RH' 253 | RL' 253 |
| 244 | RH' 254 | RL' 254 |
| 245 | RH' 255 | RL' 255 |

Gave-1

Gave-j

| R' ave | GH' | GL' |
|---|---|---|
| 0 | GH' 0 | GL' 0 |
| 1 | GH' 1 | GL' 1 |
| 2 | GH' 2 | GL' 2 |
| 3 | GH' 3 | GL' 3 |
| 4 | GH' 4 | GL' 4 |
| 5 | GH' 5 | GL' 5 |
| ⋮ | ⋮ | ⋮ |
| 50 | GH' 50 | GL' 50 |
| 51 | GH' 51 | GL' 51 |
| 52 | GH' 52 | GL' 52 |
| ⋮ | ⋮ | ⋮ |
| 253 | GH' 253 | GL' 253 |
| 254 | GH' 254 | GL' 254 |
| 255 | GH' 255 | GL' 255 |

PIXEL DRIVING METHOD, PIXEL DRIVING APPARATUS AND COMPUTER DEVICE

CROSS REFERENCE OF RELATED APPLICATIONS

The present application claims the priority to the Chinese Patent Application No. 201811383608.1, filed with National Intellectual Property Administration, PRC on Nov. 20, 2018 and entitled "PIXEL DRIVING METHOD AND PIXEL DRIVING APPARATUS", which is incorporated herein by reference in its entirety.

TECHNICAL FIELD

The present application relates to a pixel driving method, a pixel driving apparatus and a computer device.

BACKGROUND

The statements herein merely provide background information related to the present application and do not necessarily constitute the conventional art.

Currently, a Vertical Alignment (VA) liquid crystal technology or an In-Plane Switching (IPS) liquid crystal technology is mostly adopted for a large-sized display panel. The Vertical Alignment (VA) liquid crystal technology has higher production efficiency and lower cost compared with the In-Plane Switching (IPS) liquid crystal technology; however, it has more obvious defects compared with the In-Plane Switching (IPS) liquid crystal technology in optical property, especially when the large-sized display panel needs a larger viewing angle to be displayed in commercial application. As shown in FIG. 1, when the Vertical Alignment (VA) liquid crystal technology is adopted for display driving, the lightness at a large viewing angle is rapidly saturated with a signal (as shown in a curve 2), which causes the quality contrast and color shift at the large viewing angle to be worse than that at a positive viewing angle (as shown in a curve 1, lightness variation with a signal at the positive viewing angle).

Currently, the pixel driving method provided by the example technique may cause the image to have graininess due to the alternation of the bright and dark sub-pixels.

SUMMARY

The purpose of the present application is to provide a pixel driving method, a pixel driving apparatus and a computer device, so as to avoid the graininess in image display, thereby improving display quality.

A pixel driving method includes:

acquiring an average pixel signal of sub-pixels of each color in each unit pixel in a pixel block, where the unit pixel includes a red sub-pixel, a green sub-pixel and a blue sub-pixel;

acquiring a color signal of the pixel block according to the average pixel signal of the sub-pixels of each color; and loading first-type gray-scale signals to a part of same-color sub-pixels in the pixel block and loading second-type gray-scale signals to the remaining same-color sub-pixels based on a preset rule according to the color signal and a preset main color-rendering determination condition, where the first-type gray-scale signals are not equal to the corresponding second-type gray-scale signals.

The average pixel signal of the sub-pixels of each color in each unit pixel in the pixel block is acquired according to the pixel driving method provided by the embodiments of the present application, the color that the pixel block deflects to during display is determined according to the average pixel signal of the sub-pixels of each color and the preset main color-rendering determination condition, and the first-type gray-scale signal and the second-type gray-scale signal are loaded to each sub-pixel according to the determination result, then the proportion and the lightness of the high and low gray-scale voltage loaded to the pixel block are controlled, thus the graininess of the pixel block during display is improved.

In one or more embodiments, the main color-rendering determination condition includes a red-rendering condition, and the step of loading the first-type gray-scale signals to a part of same-color sub-pixels in the pixel block and loading the second-type gray-scale signals to the remaining same-color sub-pixels based on the preset rule according to the color signal and the preset main color-rendering determination condition includes:

if the color signal meets the red-rendering condition, loading the first-type gray-scale signal and the second-type gray-scale signal respectively to two adjacent red sub-pixels of each first grouping unit in the pixel block, where the first grouping unit includes two adjacent unit pixels, and no same unit pixel exists in each of the first grouping units;

and loading the first-type gray-scale signals to three green sub-pixels of each second grouping unit in the pixel block and loading the second-type gray-scale signal to one green sub-pixel in the second grouping unit, where the second grouping unit includes four adjacent unit pixels, and no same unit pixel exists in each of the second grouping units.

In one or more embodiments, the main color-rendering determination condition includes a green-rendering condition, and the step of loading the first-type gray-scale signals to a part of same-color sub-pixels in the pixel block and loading the second-type gray-scale signals to the remaining same-color sub-pixels based on the preset rule according to the color signal and the preset main color-rendering determination condition includes:

if the color signal meets the green-rendering condition, loading the first-type gray-scale signal and the second-type gray-scale signal respectively to two adjacent green sub-pixels of each first grouping unit in the pixel block;

and loading the first-type gray-scale signals to three red sub-pixels of each second grouping unit in the pixel block and loading the second-type gray-scale signal to one red sub-pixel in the second grouping unit.

In one or more embodiments, the step of loading the first-type gray-scale signals to a part of same-color sub-pixels in the pixel block and loading the second-type gray-scale signals to the remaining same-color sub-pixels based on the preset rule according to the color signal and the preset main color-rendering determination condition includes:

loading the first-type gray-scale signal and the second-type gray-scale signal respectively to blue sub-pixels of each first grouping unit in the pixel block, where the first grouping unit includes two adjacent unit pixels, and no same unit pixel exists in each of the first grouping units.

In one or more embodiments, the main color-rendering determination condition includes a blue-rendering condition, and the step of loading the first-type gray-scale signals to a part of same-color sub-pixels in the pixel block and loading the second-type gray-scale signals to the remaining same-color sub-pixels based on the preset rule according to the color signal and the preset main color-rendering determination condition includes:

if the color signal meets the blue-rendering condition, loading the first-type gray-scale signals to three red sub-pixels of each second grouping unit in the pixel block and loading the second-type gray-scale signal to the remaining one red sub-pixel in the second grouping unit;

and loading the first-type gray-scale signals to three green sub-pixels of each of the second grouping units in the pixel block and loading the second-type gray-scale signal to the remaining one green sub-pixel in the second grouping unit.

In one or more embodiments, before the step of acquiring the average pixel signal of the sub-pixels of each color in each unit pixel in the pixel block, the method further includes:

loading a group of initial high and initial low gray-scale signals to same-color sub-pixels in a first grouping unit of the pixel block, where the first grouping unit includes two adjacent unit pixels, and no same unit pixel exists in each of the first grouping units.

In one or more embodiments, a color signal includes chroma and hue angle, and the red-rendering condition is:

$$0°<H\leq 45° \text{ or } 315°<H\leq 360°, \text{ and } C_{TL1}\leq C\leq C_{TH2}$$

where H is chroma, C is hue angle, $C_{TL1}$ is the lowest predefined red hue threshold value, and $C_{TH2}$ is the highest predefined red hue threshold value.

A pixel driving apparatus includes:

an average signal acquisition circuit for acquiring average pixel signal of sub-pixels of each color in each unit pixel in a pixel block, where the unit pixel includes a red sub-pixel, a green sub-pixel and a blue sub-pixel;

a color signal acquisition unit for acquiring a color signal of the pixel block according to the average pixel signal of the sub-pixels of each color; and a driving signal loading unit for loading first-type gray-scale signals to a part of same-color sub-pixels in the pixel block and loading second-type gray-scale signals to the remaining same-color sub-pixels based on a preset rule according to the color signal and a preset main color-rendering determination condition, where the first-type gray-scale signals are not equal to the corresponding second-type gray-scale signals.

A computer device includes a memory and a processor, where the memory stores a computer program, which is characterized in that the processor when executing the computer program implements the steps of:

acquiring an average pixel signal of sub-pixels of each color in each unit pixel in a pixel block, where the unit pixel includes a red sub-pixel, a green sub-pixel and a blue sub-pixel;

acquiring a color signal of the pixel block according to the average pixel signal of the sub-pixels of each color; and loading first-type gray-scale signals to a part of same-color sub-pixels in the pixel block and loading second-type gray-scale signals to the remaining same-color sub-pixels based on a preset rule according to the color signal and a preset main color-rendering determination condition, where the first-type gray-scale signals are not equal to the corresponding second-type gray-scale signals.

In one or more embodiments, a processor, when executing the computer readable instructions, further performs the steps of:

if the color signal meets the red-rendering condition, loading the first-type gray-scale signal and the second-type gray-scale signal respectively to two adjacent red sub-pixels of each first grouping unit in the pixel block, where the first grouping unit includes two adjacent unit pixels, and no same unit pixel exists in each of the first grouping units;

and loading the first-type gray-scale signals to three green sub-pixels of each second grouping unit in the pixel block and loading the second-type gray-scale signal to one green sub-pixel in the second grouping unit, where the second grouping unit includes four adjacent unit pixels, and no same unit pixel exists in each of the second grouping units.

In one or more embodiments, a processor, when executing the computer readable instructions, further performs the steps of:

if the color signal meets the green-rendering condition, loading the first-type gray-scale signal and the second-type gray-scale signal respectively to two adjacent green sub-pixels of each first grouping unit in the pixel block;

and loading the first-type gray-scale signals to three red sub-pixels of each second grouping unit in the pixel block and loading the second-type gray-scale signal to one red sub-pixel in the second grouping unit.

In one or more embodiments, a processor, when executing the computer readable instructions, further performs the steps of:

loading the first-type gray-scale signal and the second-type gray-scale signal respectively to blue sub-pixels of each first grouping unit in the pixel block, where the first grouping unit includes two adjacent unit pixels, and no same unit pixel exists in each of the first grouping units.

In one or more embodiments, a processor, when executing the computer readable instructions, further performs the steps of:

if the color signal meets the blue-rendering condition, loading the first-type gray-scale signals to three red sub-pixels of each second grouping unit in the pixel block and loading the second-type gray-scale signal to the remaining one red sub-pixel in the second grouping unit;

and loading the first-type gray-scale signals to three green sub-pixels of each of the second grouping units in the pixel block and loading the second-type gray-scale signal to the remaining one green sub-pixel in the second grouping unit.

In one or more embodiments, a processor, when executing the computer readable instructions, further performs the steps of:

loading a group of initial high and initial low gray-scale signals to same-color sub-pixels in a first grouping unit of the pixel block, where the first grouping unit includes two adjacent unit pixels, and no same unit pixel exists in each of the first grouping units.

In one or more embodiments, a color signal includes chroma and hue angle, and the red-rendering condition is:

$$0°<H\leq 45° \text{ or } 315°<H\leq 360°, \text{ and } C_{TL1}\leq C\leq C_{TH2}$$

where H is chroma, C is hue angle, $C_{TL1}$ is the lowest predefined red hue threshold value, and $C_{TH2}$ is the highest predefined red hue threshold value.

The details of one or more embodiments of the present application are set forth in the accompanying drawings and the description below. Other features and advantages of the present application will be apparent from the specification, drawings and claims.

BRIEF DESCRIPTION OF DRAWINGS

In order to more clearly illustrate the technical solutions of the embodiments of the present application, the drawings required in the description of the embodiments will be briefly described below. Obviously, the drawings in the following description are merely some embodiments of the present application, and those of ordinary skill in the art can acquire other drawings according to the drawings without any inventive labor.

FIG. 6 is a table showing the relationship between a first-type gray-scale signal and a second-type gray-scale signal corresponding to each average pixel signal according to an embodiment;

DETAILED DESCRIPTION OF EMBODIMENTS

In order to make the technical solutions and advantages of the present application more clearly understood, the present application is further described in detail below with reference to the accompanying drawings and embodiments. It should be understood that the specific embodiments described herein are only for explaining, but not for limiting the present application.

It should be noted that when an element is referred to as being "connected to" another element, it can be directly connected to the other element, or an intervening element may also be present. The terms "mounted", "one end", "the other end" and the like as used herein are for illustration purposes only.

Unless defined otherwise, all technical and scientific terms used herein have the same meaning as commonly understood by one of ordinary skill in the art to which the present application belongs. The term used in the specification of the present application herein is for the purpose of describing particular embodiment only and is not intended to be limiting of the present application. As used herein, the term "and/or" includes any and all combinations of one or more of the associated listed items.

Figure 1:
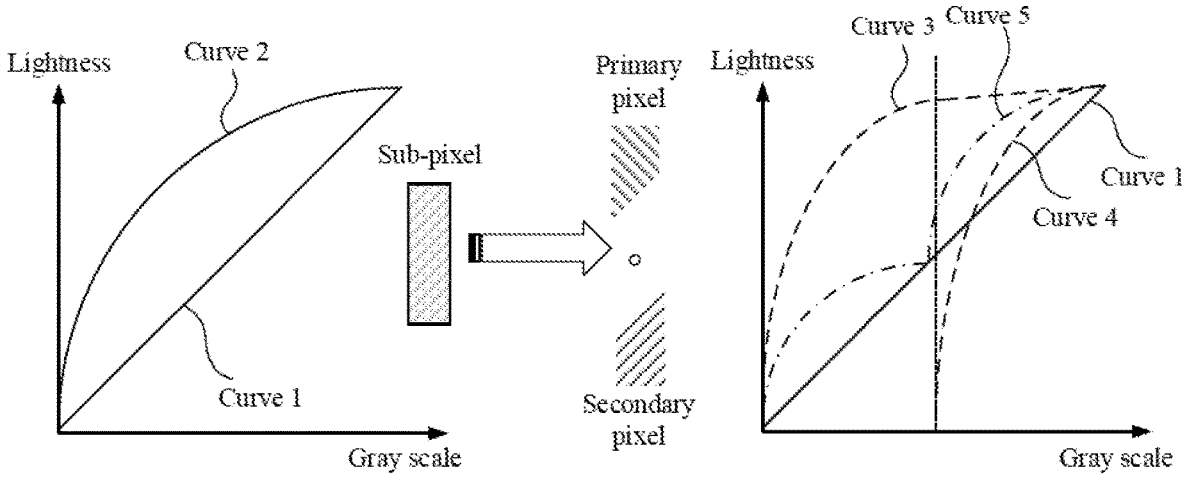
FIG. 1 shows the display lightness of pixels varying with gray-scale signals at a positive viewing angle and a large viewing angle when a VA liquid crystal technology is adopted for display driving.
Figure 2:
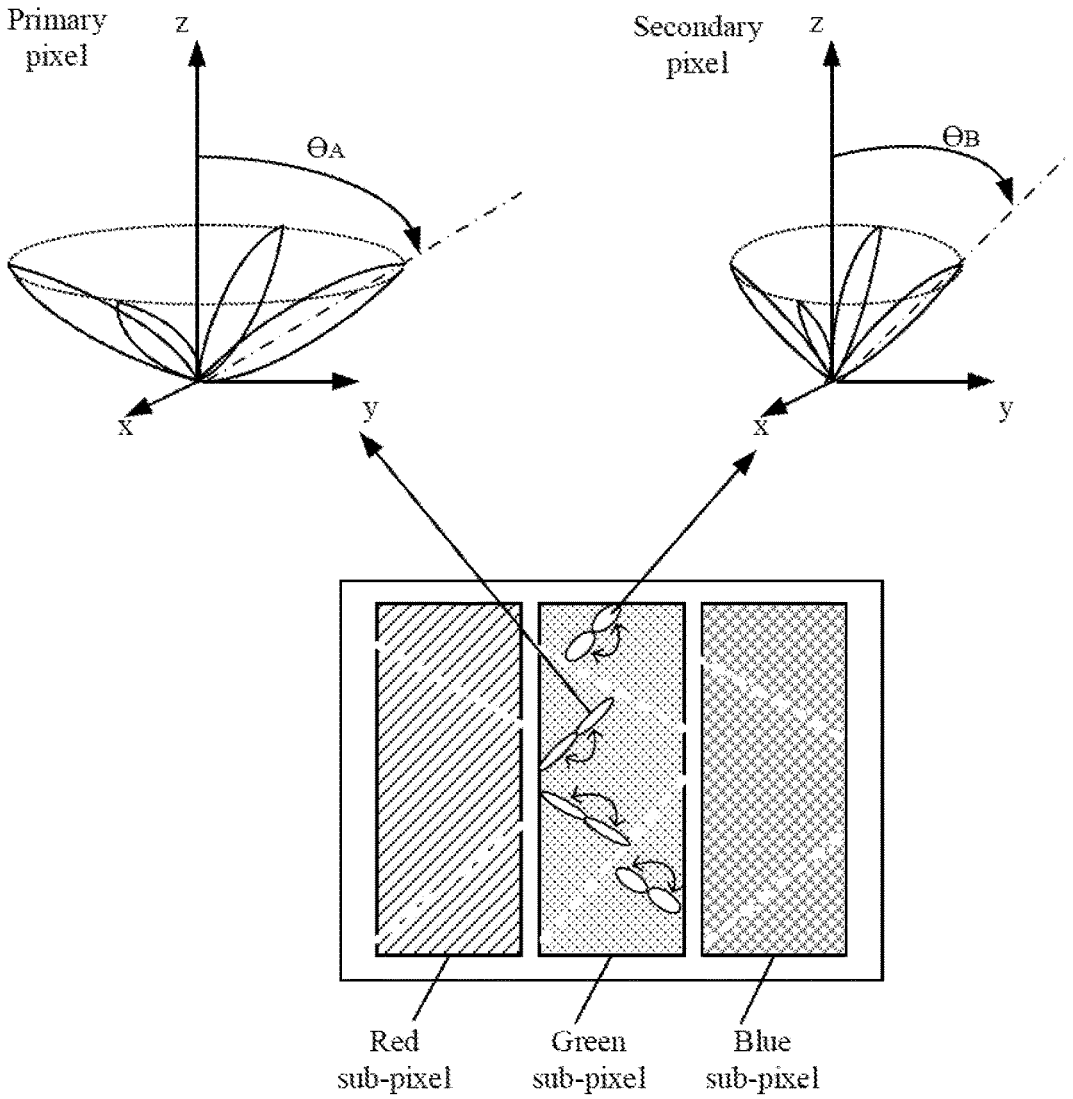
FIG. 2 shows the display lightness of primary pixels and secondary pixels varying with gray-scale signals at the positive viewing angle and the large viewing angle when the primary pixels and the secondary pixels are driven by respectively loading different gray-scale signals.

In an example technique, two adjacent red sub-pixels (green sub-pixels/blue sub-pixels) are divided into primary pixels and secondary pixels, and then different gray-scale voltages are applied to the primary pixels and the secondary pixels, as shown in FIG. 1. When the divided primary pixels and secondary pixels applied with different gray-scale voltages are driven (curve 3 is the variation of the primary pixels lightness with signals, and curve 4 is the variation of the secondary pixels lightness with signals), the curve (curve 5) in which side-view lightness of the display panel composed of the primary pixels and secondary pixels varies with signals is closer to curve (curve 1) in which positive-view lightness varies with signals, as shown in FIG. 2. Taking green sub-pixels as an example, the defect of the color shift of viewing angle can be solved by spatially designing the primary pixels and secondary pixels and applying different driving signals to them.

Figures 3, 4:
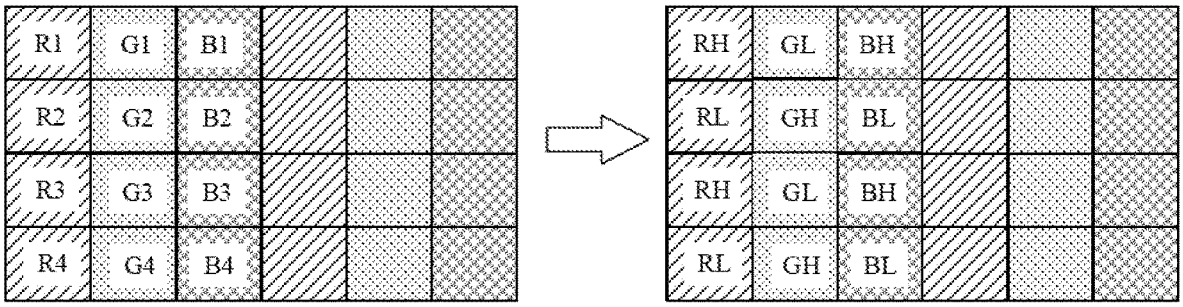
FIG. 3 is a schematic diagram of pixel voltage distribution of the primary pixels and the secondary pixels of a pixel driving method according to an embodiment.
FIG. 4 is a table showing a relationship between the high and low gray-scale signals respectively loaded to the primary pixels and the secondary pixels and the average pixel signal according to an embodiment.

Referring to FIG. 3, for the red sub-pixels, by sacrificing spatial resolution, a group of high and low gray-scale signals RH and RL can be used to replace original signals R1 and R2 of the sub-pixels, and the combination of the high gray-scale signal and the low gray-scale signal can achieve the effect of improving the color shift of viewing angle. At the positive viewing angle, the average lightness of the group of high and low gray-scale signals RH and RL can maintain the same as that of the original two independent sub-pixel signals R1 and R2. Referring to FIG. 4, taking 8-bit display driver as an example, the gray-scale signal of each sub-pixel is 0, 1, . . . , or 255, the two original independent sub-pixel signals R1, R2 are also gray-scale signals in 0, 1, . . . , 255, the average signal Rave of two adjacent same-color sub-pixels R1, R2 is also a gray-scale signals that is 0, 1, . . . , or 255, and a group of high and low gray-scale signals RH and RL corresponding to the average signal Rave of two adjacent sub-pixels can be found by looking up a table. As shown in FIG. 3, two adjacent same-color sub-pixels are driven to display by high and low gray-scale signals, respectively. In summary of the implementation process of the present applicant, it is found that the above-mentioned manner of driving each sub-pixel by high and low gray-scale signal spatially can improve the color shift of viewing angle. However, due to the alternation of bright and dark sub-pixels, when the lightness difference of the bright and dark sub-pixels is large, the graininess during display is easily occurred, thus the display quality cannot be ensured.

Based on the above, it is desirable to provide a pixel driving method, a pixel driving apparatus, a computer device, and a computer-readable storage medium for solving a problem of the graininess in image display.

Figure 5:
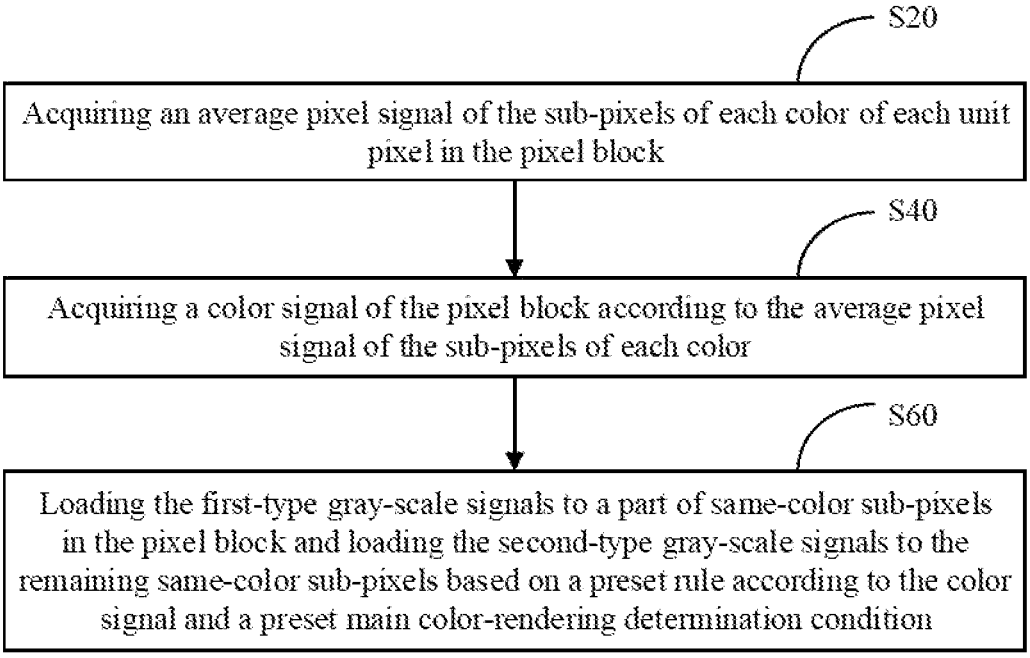
FIG. 5 is a flow schematic diagram of a pixel driving method according to an embodiment.

In one aspect, as shown in FIG. 5, the embodiments of the present application provide a pixel driving method, and the method includes:

S20: acquiring an average pixel signal of sub-pixels of each color in each unit pixel in a pixel block, where the unit pixel includes a red sub-pixel, a green sub-pixel and a blue sub-pixel;

S40: acquiring a color signal of the pixel block according to the average pixel signal of the sub-pixels of each color; and S60: loading first-type gray-scale signals to a part of same-color sub-pixels in the pixel block and loading second-type gray-scale signals to the remaining same-color sub-pixels based on a preset rule according to the color signal and a preset main color-rendering determination condition, where the first-type gray-scale signals are not equal to the corresponding second-type gray-scale signals.

The pixel block may be a block including a plurality of unit pixels, for example, a pixel block may be a block including n*m unit pixels. The unit pixel includes a red sub-pixel, a green sub-pixel, and a blue sub-pixel. The main color-rendering determination condition is used to determine which one of red, green and blue that the pixel block composed of unit pixels deflects to during display. The preset rule is a rule preset by experience such as experiments and used to direct the adjustment of the difference value of the first-type gray-scale signals and the second-type gray-scale signals loaded to the same-color sub-pixels in each unit pixel and the adjustment of the proportion of the sub-pixels loaded with the first-type gray-scale signals and the second-type gray-scale signals in the pixel block so as to weaken the graininess when the pixel block is displayed. As shown in FIG. 6, the first-type gray-scale signal and the second-type gray-scale signal are set correspondingly, that is, each first-type gray-scale signal corresponds to second-type gray-scale signal, and the value of the first-type gray-scale signal is not equal to that of the corresponding second-type gray-scale signal. Optionally, the average signal of the sub-pixel of each color corresponds to a group of first-type and second-type gray-scale signals.

When a display panel composed of multi-color sub-pixels is displayed, due to different loaded pixel voltages, the color that each pixel block deflects to is also different. The sensitivity of human eyes to the graininess caused by the difference of high and low gray-scale signals when the sub-pixels of each color in each pixel block are displayed is also different due to different color-deflection degree. Therefore, firstly, the average pixel signal of the sub-pixels of each color in each unit pixel in the pixel block is acquired, the color signal of the pixel block is acquired according to the average pixel signal of the sub-pixels of each color, then the color that the pixel block deflects to during display is determined according to the color signal and the preset main color-rendering determination condition, and the first-type gray-scale signals are loaded to a part of same-color sub-pixels in the pixel block and the second-type gray-scale signals are loaded to the remaining same-color sub-pixels based on a preset rule according to the deflected color. The part of the same-color sub-pixels and the remaining same-color sub-pixels referred to herein refer to sub-pixels with the same color. The rule for loading the gray-scale signals is for the same-color sub-pixels in the unit pixel.

Figure 7:
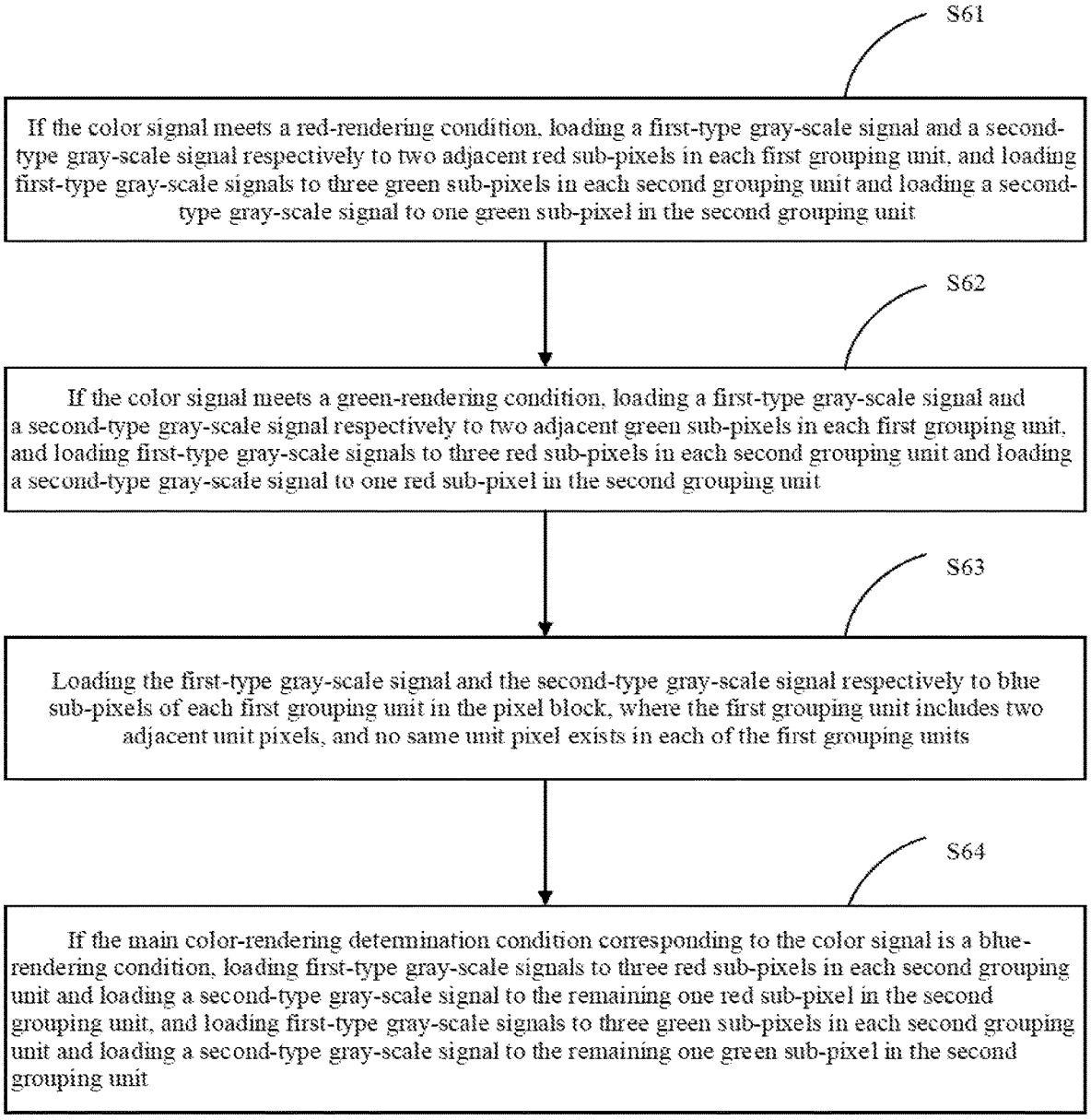
FIG. 7 is a flow schematic diagram of a step of loading the first-type gray-scale signals to a part of same-color sub-pixels in the pixel block and loading the second-type gray-scale signals to the remaining same-color sub-pixels based on the preset rule according to the color signal and the preset main color-rendering determination condition according to an embodiment.

In one or more embodiments, as shown in FIG. 7, the main color-rendering determination condition includes a red-rendering condition, and the step of loading the first-type gray-scale signals to a part of same-color sub-pixels in the pixel block and loading the second-type gray-scale signals to the remaining same-color sub-pixels based on the preset rule according to the color signal and the preset main color-rendering determination condition includes:

S61: if the color signal meets the red-rendering condition, loading the first-type gray-scale signal and the second-type gray-scale signal respectively to two adjacent red sub-pixels of each first grouping unit in the pixel block, where the first grouping unit includes two adjacent unit pixels, and no same unit pixel exists in each of the first grouping units;

and loading the first-type gray-scale signals to three green sub-pixels of each second grouping unit in the pixel block and loading the second-type gray-scale signal to one green sub-pixel in the second grouping unit, where the second grouping unit includes four adjacent unit pixels, and no same unit pixel exists in each of the second grouping units.

Figures 8, 9:
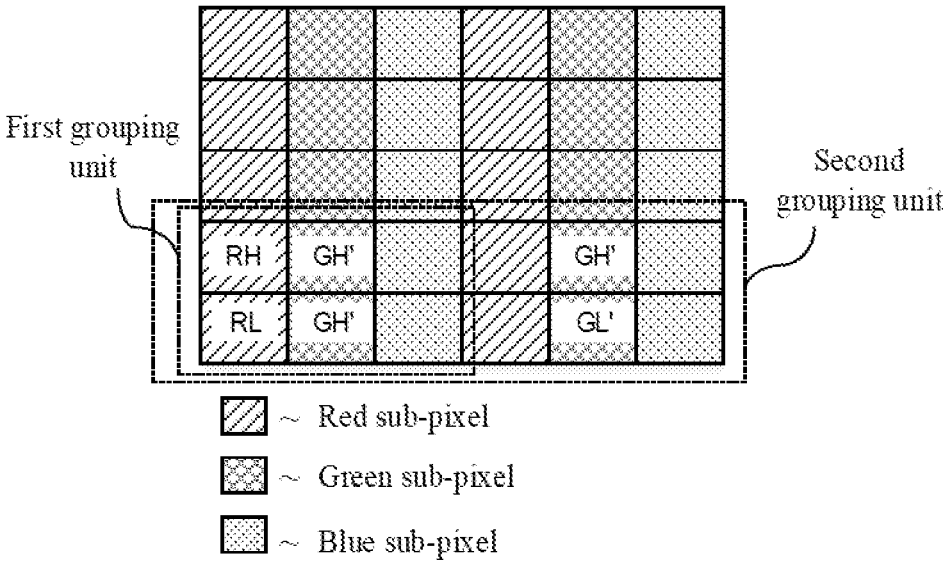
FIG. 8 is a schematic diagram of loading a gray-scale signal to each sub-pixel according to an embodiment.
FIG. 9 is a table showing the relationship between a first-type gray-scale signal and a second-type gray-scale signal corresponding to each average pixel signal according to another embodiment.

According to the Commission Internationale de L'Eclairage (CIE 国际) specifications, L (Lightness), C (Chroma), and H (Hue) are functions with respect to R, G, B three-color space coordinates in a color coordinate system, where L=f1(R, G, B), C=f1(R, G, B), and H=f1(R, G, B), respectively. Referring to FIG. 8, H is color representative, which represents different hue colors with 0° to 360°, where 0° is red, 90° is yellow, 180° is green, and 270° is blue. C is color purity, which represents chroma. The range of C is 0 to 100, where 100 represents brighter color and the value of C represents the display of high and low gray-scale signals on the LCD. The corresponding LCH value can be acquired by acquiring the pixel signal of the red sub-pixel, the pixel signal of the green sub-pixel, and the pixel signal of the blue sub-pixel.

Specifically, in this embodiment, average pixel signal R of the red sub-pixel, average pixel signal G of the green sub-pixel, and average pixel signal B of the blue sub-pixel in the pixel block are acquired by acquiring pixel signal of the sub-pixels of each color, and the lightness, the chroma, and the hue angle of the color signal corresponding to the pixel block can be acquired according to the acquired average pixel signal of the sub-pixels of each color. If the color signal meets the preset red-rendering condition, it is indicated that the average color signal of the pixel block is deflected to red during display, and thus for most of red sub-pixels of the pixel block, 2 adjacent red sub-pixel signals of each first grouping unit in the interval are averaged, and the first-type gray-scale signal and the second-type gray-scale signal corresponding to the average pixel signal are acquired by looking up a table to drive the two adjacent red sub-pixels respectively according to FIG. 6 and FIG. 8. For the green sub-pixel, 4 adjacent green sub-pixel signals of the second grouping unit in the interval are averaged to acquire the first-type gray-scale signal GH' and one second-type gray-scale signal GL' corresponding to the average pixel signal, and then the first-type gray-scale signals GH' are loaded to three green sub-pixels in the second grouping unit, and the second-type gray-scale signal GL' is loaded to the remaining one green sub-pixel according to FIG. 8 and FIG. 9. It should be noted that the first-type gray-scale signal and the second-type gray-scale signal may be acquired by looking up a preset table. The first-type gray-scale signal may be a high gray-scale signal relative to the second-type gray-scale signal, or may be a medium-low gray-scale signal relative to the second-type gray-scale signal, or may be a low gray-scale signals relative to the second-type gray-scale signal.

In one or more embodiments, as shown in FIG. 7, the main color-rendering determination condition includes a green-rendering condition, and the step of loading the first-type gray-scale signals to a part of same-color sub-pixels in the pixel block and loading the second-type gray-scale signals to the remaining same-color sub-pixels based on the preset rule according to the color signal and the preset main color-rendering determination condition includes:

S62: if the color signal meets the green-rendering condition, loading the first-type gray-scale signal and the second-type gray-scale signal respectively to two adjacent green sub-pixels of each first grouping unit in the pixel block;

and loading the first-type gray-scale signals to three red sub-pixels of each second grouping unit in the pixel block and loading the second-type gray-scale signal to one red sub-pixel in the second grouping unit.

Figure 10:
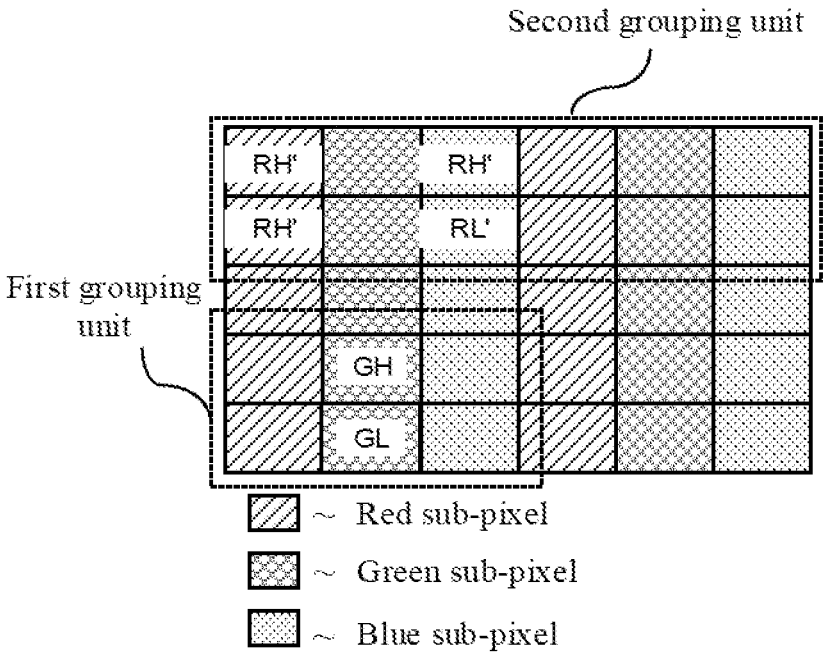
FIG. 10 is a schematic diagram of loading gray-scale signals to each sub-pixel according to yet another embodiment.

Similarly, if the color signal meets the green-rendering condition, it is indicated that for most of green sub-pixels of the pixel block, the 2 adjacent green sub-pixel signals of each first grouping unit in the interval are averaged, and the first-type gray-scale signal GH and the second-type gray-scale signal GL corresponding to the averaged pixel signal are acquired by looking up a table to drive the two adjacent green sub-pixels respectively according to FIG. 6 and FIG. 10. For the red sub-pixel, 4 adjacent red sub-pixel signals of the second grouping unit in the interval are averaged to acquire the first-type gray-scale signal RH' and one second-type gray-scale signal RL' corresponding to the average pixel signal, and then the first-type gray-scale signals RH' are loaded to three red sub-pixels in the second grouping unit, and the second-type gray-scale signal is loaded to the remaining one red sub-pixel according to FIG. 9 and FIG. 10. It should be noted that the fast-tare gray-scale signal and the second-type gray-scale signal may be acquired by looking up a preset table. The first-type gray-scale signal may be a high gray-scale signal relative to the second-type gray-scale signal, or may be a medium-low gray-scale signal relative to the second-type gray-scale signal, or may be a low gray-scale signals relative to the second-type gray-scale signal.

In one or more embodiments, as shown in FIG. 7, the step of loading the first-type gray-scale signals to a part of same-color sub-pixels in the pixel block and loading the second-type gray-scale signals to the remaining same-color sub-pixels based on the preset rule according to the color signal and the preset main color-rendering determination condition includes:

S63: loading the first-type gray-scale signal and the second-type gray-scale signal respectively to blue sub-pixels of each first grouping unit in the pixel block, where the first grouping unit includes two adjacent unit pixels, and no same unit pixel exists in each of the first grouping units.

Because human eyes have low sensitivity to the variation of blue color lightness and to the difference of lightness of blue sub-pixels, for the driving signals of the blue sub-pixels, a group of first-type and second-type gray-scale signals corresponding to the average pixel signal of every two adjacent blue sub-pixels can be used to respectively replace the pixel signals B1 and B2 originally loaded to the two adjacent blue sub-pixels, the combination of the first-type gray-scale signal and the second-type gray-scale signal can achieve the effect of improving the color shift of viewing angle, and at the positive viewing angle, the average lightness of the group of first-type and second-type gray-scale signals can maintain the same as that of the original two independent sub-pixel signals B1 and B2. Optionally, for the blue sub-pixel, the original two independent blue sub-pixel signals B1 and B2 may also be maintained.

In one or more embodiments, as shown in FIG. 7, the main color-rendering determination condition includes blue-rendering condition, and the step of loading the first-type gray-scale signals to a part of same-color sub-pixels in the pixel block and loading the second-type gray-scale signals to the remaining same-color sub-pixels based on the preset rule according to the color signal and the preset main color-rendering determination condition includes:

S64: if the main color-rendering determination condition corresponding to the color signal is a blue-rendering condition, loading the first-type gray-scale signals to three red sub-pixels of each second grouping unit in the pixel block and loading the second-type gray-scale signal to the remaining one red sub-pixel in the second grouping unit;

and loading the first-type gray-scale signals to three green sub-pixels of each of the second grouping units in the pixel block and loading the second-type gray-scale signal to the remaining one green sub-pixel in the second grouping unit.

If the color signal meets the blue-rendering condition, it is indicated that the average color signal of the pixel block is deflected to blue, and thus for most of red sub-pixels of the pixel block, the first-type gray-scale signal and the second-type gray-scale signal corresponding to the average pixel signal of every 4 adjacent red sub-pixels of each second grouping unit in the interval can be acquired, where the first-type gray-scale signals (high-voltage gray-scale signal RH') are loaded to 3 red sub-pixels, and the second-type gray-scale signal (low-voltage gray-scale signal RL') is loaded to the remaining one red sub-pixel according to FIG. 9. Similarly, for the green sub-pixels, the first-type gray-scale signal and the second-type gray-scale signal may also be acquired, the first-type gray-scale signals are loaded to three of the four green sub-pixels, and the second-type gray-scale signal is loaded to the remaining one green sub-pixel according to FIG. 9.

Figure 11:
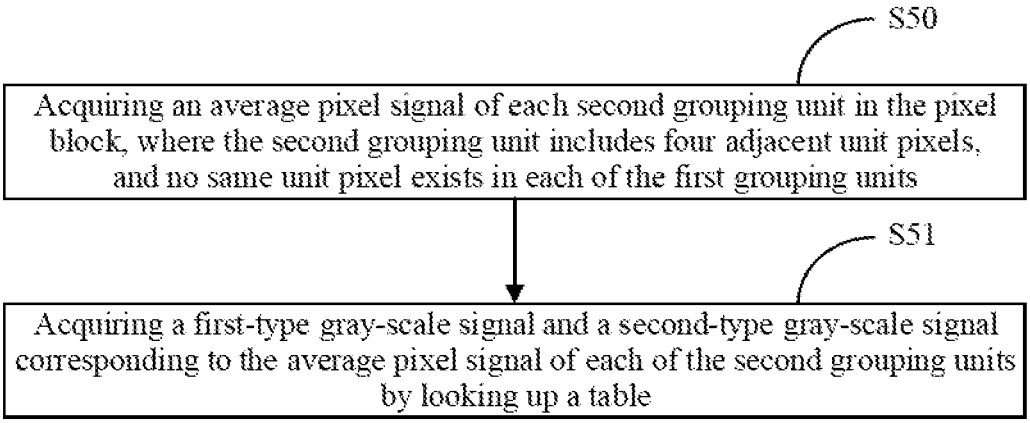
FIG. 11 is a schematic diagram of a step of acquiring a first-type gray-scale signal and a second-type gray-scale signal according to an embodiment.

In one or more embodiments, as shown in FIG. 11, the step of acquiring the first-type gray-scale signal and the second-type gray-scale signal loaded to each second grouping unit includes:

S50: acquiring an average pixel signal of each second grouping unit in the pixel block, where the second grouping unit includes four adjacent unit pixels, and no same unit pixel exists in each of the second grouping units; and S51: acquiring first-type gray-scale signal and second-type gray-scale signal corresponding to the average pixel signal of each second grouping unit by looking up a table.

Figure 12:
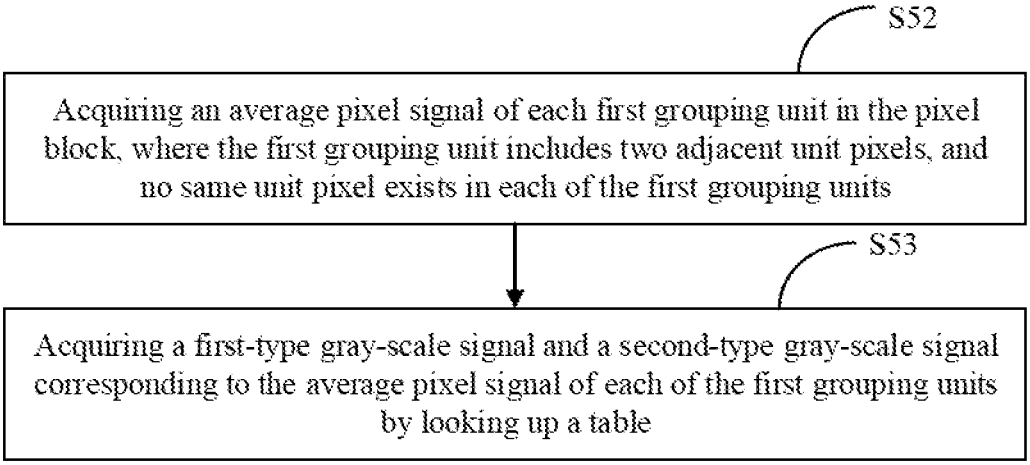
FIG. 12 is a schematic diagram of a step of acquiring a first-type gray-scale signal and a second-type gray-scale signal according to yet another embodiment.

In one or more embodiments, as shown in FIG. 12, the step of acquiring the first-type gray-scale signal and the second-type gray-scale signal loaded to each first grouping unit includes:

S52: acquiring an average pixel signal of each first grouping unit in the pixel block, where the first grouping unit includes two adjacent unit pixels, and no same unit pixel exists in each of the first grouping units; and S53: acquiring first-type gray-scale signal and second-type gray-scale signal corresponding to the average pixel signal of each first grouping unit by looking up a table.

Figure 13:
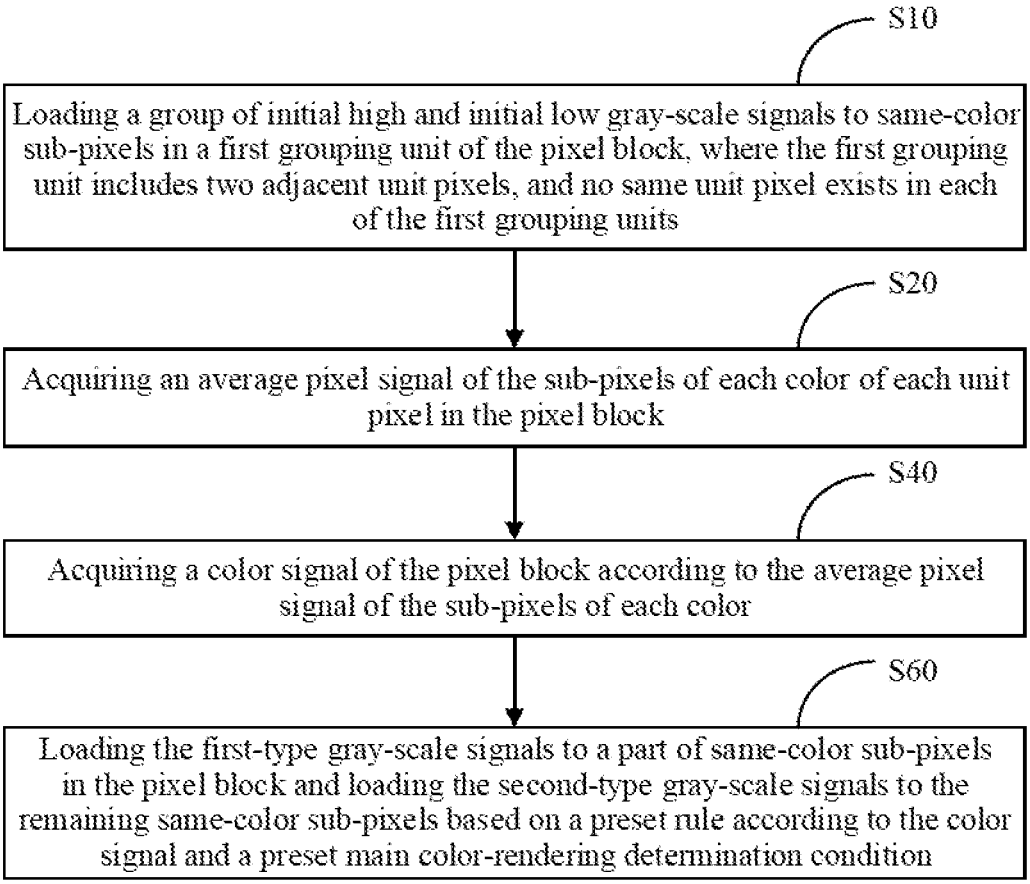
FIG. 13 is a flow schematic diagram of a pixel driving method according to still another embodiment.

In one or more embodiments, as shown in FIG. 13, before the step of acquiring the average pixel signal of the sub-pixels of each color in each unit pixel in the pixel block, the method further includes:

S10: loading a group of initial high and initial low gray-scale signals to same-color sub-pixels in a first grouping unit of the pixel block, where the first grouping unit includes two adjacent unit pixels, and no same unit pixel exists in each of the first grouping units.

In order to better ensure the large-viewing-angle display effect when the pixel block is displayed, a group of initial high and initial low gray-scale signals are loaded to every two adjacent unit pixels during initialization. And then whether the pixel block has graininess during display is determined. If so, a group of first-type and second-type gray-scale signals corresponding to the average pixel signal of every four adjacent same-color sub-pixels are acquired, and the first-type gray-scale signals and the second-type gray-scale signals are loaded to each unit pixel according to a preset rule. If not, a group of first-type and second-type gray-scale signals corresponding to the average pixel signal of every two adjacent sub-pixels can be used to replace the original initial high gray-scale signal and the initial low gray-scale signal. Or if not, the original initial high gray-scale signal and the initial low gray-scale signal can be remained unchanged, where the initial high gray-scale signal and the initial low gray-scale signal can be acquired by looking up a table. It should be noted that the loading of the initial high gray-scale signal and the loading of the initial low gray-scale signal herein are both for the same-color sub-pixels in two adjacent unit pixels.

In one or more embodiments, a color signal includes chroma and hue angle, and the red-rendering condition is:

$$0°<H\leq 45° \text{ or } 315°<H\leq 360°, \text{ and } C_{TL1}\leq C\leq C_{TH2}$$

where H is chroma, C is hue angle, $C_{TL1}$ is the lowest predefined red hue threshold value, and $C_{TH2}$ is the highest predefined red hue threshold value.

It should be understood that although the various steps of the flow diagrams in FIGS. 5 to 13 are shown in order as indicated by arrows, the steps are not necessarily performed in order as indicated by the arrows. The steps are not limited to being performed in the exact order illustrated and, unless explicitly stated herein, may be performed in other orders. Moreover, at least some of the steps in FIGS. 5 to 13 may include multiple sub-steps or multiple stages that are not necessarily performed at the same time, but may be performed at different times, and the sub-steps or stages are not necessarily performed sequentially, but may be performed in turn or alternately with other steps or at least some of the sub-steps or stages of other steps.

Figure 14:
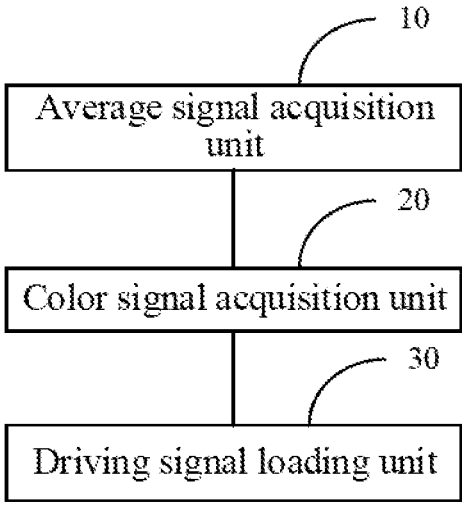
FIG. 14 is a structural schematic diagram of a pixel driving apparatus according to an embodiment.

A pixel driving apparatus, as shown in FIG. 14, includes:

an average signal acquisition circuit 10 for acquiring average pixel signal of sub-pixels of each color in each unit pixel in a pixel block, where the unit pixel includes a red sub-pixel, a green sub-pixel and a blue sub-pixel;

a color signal acquisition circuit 20 for acquiring color signal of the pixel block according to the average pixel signal of the sub-pixels of each color; and a driving signal loading circuit 30 for loading first-type gray-scale signals to a part of same-color sub-pixels in the pixel block and loading second-type gray-scale signals to the remaining same-color sub-pixels based on a preset rule according to the color signal and a preset main color-rendering determination condition, where the first-type gray-scale signals are not equal to the corresponding second-type gray-scale signals.

The definitions of the pixel block, the unit pixel, etc. are the same as those in the above embodiments, and are not repeated herein. The average signal acquisition circuit 10 acquires average pixel signal of the sub-pixels of each color in each unit pixel in the pixel block and sends the average pixel signal to the color signal acquisition circuit 20, then the color signal acquisition circuit 20 acquires the color signal of the pixel block according to the average pixel signal of the sub-pixels of each color, and the driving signal loading circuit 30 loads the first-type gray-scale signals to a part of same-color sub-pixels in the pixel block and loads the second-type gray-scale signals to the remaining same-color sub-pixels based on a preset rule according to the color signal and a preset main color-rendering determination condition.

The definition of the pixel driving method above can be referred to for the specific definition of the pixel driving apparatus, which thereby will not be described herein again. The circuit modules in the above pixel driving apparatus can be wholly or partially implemented by software, hardware and a combination thereof. The above modules can be a hardware incorporated in or independent of a processor in the computer device, and can also be stored in a memory in the computer device in the form of a software, such that the processor can call and execute operations corresponding to the modules.

Figure 15:
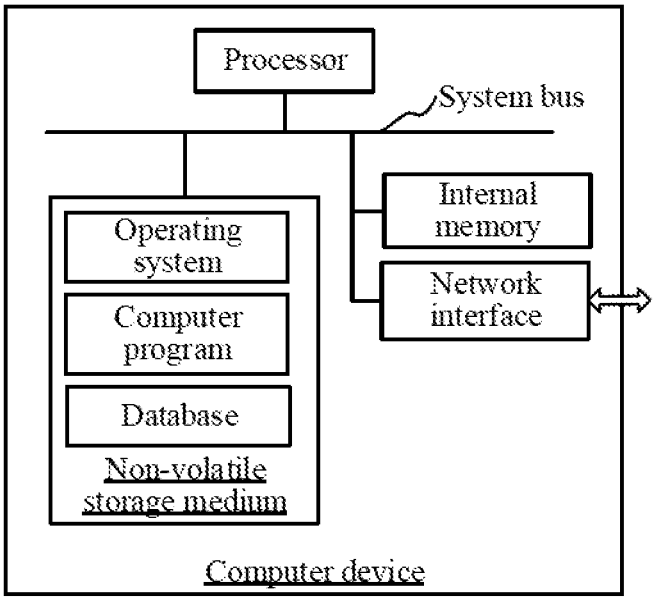
FIG. 15 is a diagram of an internal structure of a computer device according to an embodiment.

In one or more embodiments, a computer device is provided, which may be a server, and the internal structure diagram thereof may be as shown in FIG. 15. The computer device includes a processor, a memory, a network interface, and a database connected by a system bus. The processor of the computer device is used to provide computing and controlling capabilities. The memory of the computer device includes a non-volatile storage medium and an internal memory. The non-volatile storage medium stores an operating system, a computer program, and a database. The internal memory provides an environment for the operation of the operating system and the computer program in the non-volatile storage medium. The database of the computer device is used to store data such as a signal determination interval, a first-type gray-scale signal and a second-type gray-scale signal. The network interface of the computer device is used to communicate with an external terminal through a network connection. The computer program is executed by the processor to implement a pixel driving method.

It will be understood by those skilled in the art that the structure shown in FIG. 15 is only a block diagram of part of structure associated with the present application, and is not intended to limit the computer device to which the present application may be applied, and that a specific computer device may include more or fewer components than shown in the FIG. 15, or may combine certain components, or have a different arrangement of components.

A computer device includes a memory and a processor, where the memory stores a computer program, the processor when executing the computer program implements the steps of:

S20: acquiring an average pixel signal of sub-pixels of each color in each unit pixel in a pixel block, where the unit pixel includes a red sub-pixel, a green sub-pixel and a blue sub-pixel;

S40: acquiring a color signal of the pixel block according to the average pixel signal of the sub-pixels of each color; and S60: loading first-type gray-scale signals to a part of same-color sub-pixels in the pixel block and loading second-type gray-scale signals to the remaining same-color sub-pixels based on a preset rule according to the color signal and a preset main color-rendering determination condition, where the first-type gray-scale signals are not equal to the corresponding second-type gray-scale signals.

When the computer device provided by the embodiment of the application operates, the main color of each pixel block during display can be determined according to the pixel signal of the sub-pixel of the pixel block, and then the first-type gray-scale signal and the second-type gray-scale signal are loaded to each unit pixel of the pixel block according to a pre-stored preset rule, so that the graininess of the pixel block during display is reduced, and the display quality is improved.

In one or more embodiments, the processor in the computer device, when executing the computer readable instructions, further performs the steps of:

S61: if the color signal meets the red-rendering condition, loading the first-type gray-scale signal and the second-type gray-scale signal respectively to two adjacent red sub-pixels of each first grouping unit in the pixel block, where the first grouping unit includes two adjacent unit pixels, and no same unit pixel exists in each of the first grouping units;

and loading the first-type gray-scale signals to three green sub-pixels of each second grouping unit in the pixel block and loading the second-type gray-scale signal to one green sub-pixel in the second grouping unit, where the second grouping unit includes four adjacent unit pixels, and no same unit pixel exists in each of the second grouping units.

In one or more embodiments, the processor in the computer device, when executing the computer readable instructions, further performs the steps of:

S62: if the color signal meets the green-rendering condition, loading the first-type gray-scale signal and the second-type gray-scale signal respectively to two adjacent green sub-pixels of each first grouping unit in the pixel block;

and loading the first-type gray-scale signals to three red sub-pixels of each second grouping unit in the pixel block and loading the second-type gray-scale signal to one red sub-pixel in the second grouping unit.

In one or more embodiments, the processor in the computer device, when executing the computer readable instructions, further performs the steps of:

S63: loading the first-type gray-scale signal and the second-type gray-scale signal respectively to blue sub-pixels of each first grouping unit in the pixel block, where the first grouping unit includes two adjacent unit pixels, and no same unit pixel exists in each of the first grouping units.

In one or more embodiments, the processor in the computer device, when executing the computer readable instructions, further performs the steps of:

S64: if the color signal meets the blue-rendering condition, loading the first-type gray-scale signals to three red sub-pixels of each second grouping unit in the pixel block and loading the second-type gray-scale signal to the remaining one red sub-pixel in the second grouping unit;

and loading the first-type gray-scale signals to three green sub-pixels of each of the second grouping units in the pixel block and loading the second-type gray-scale signal to the remaining one green sub-pixel in the second grouping unit.

In one or more embodiments, the processor in the computer device, when executing the computer readable instructions, further performs the steps of:

if determining that the pixel signal of the pixel block meets the first condition, acquiring an average pixel signal of each second grouping unit in the pixel block, where the second grouping unit includes four adjacent unit pixels, and no same unit pixel exists in each of the second grouping units; and acquiring first-type gray-scale signal and second-type gray-scale signal corresponding to the average pixel signal of each second grouping unit by looking up a table.

In one or more embodiments, the processor in the computer device, when executing the computer readable instructions, further performs the steps of:

if determining that the pixel signal of the pixel block meets the first condition, acquiring an average pixel signal of each second grouping unit in the pixel block, where the second grouping unit includes four adjacent unit pixels, and no same unit pixel exists in each of the second grouping units; and acquiring first-type gray-scale signal and second-type gray-scale signal corresponding to the average pixel signal of each second grouping unit by looking up a table.

In one or more embodiments, the processor in the computer device, when executing the computer readable instructions, further performs the steps of:

if determining that the pixel signal of the pixel block does not meet the first condition, acquiring an average pixel signal of each first grouping unit in the pixel block, where the first grouping unit includes two adjacent unit pixels, and no same unit pixel exists in each of the first grouping units; and acquiring first-type gray-scale signal and second-type gray-scale signal corresponding to the average pixel signal of each first grouping unit by looking up a table.

In one or more embodiments, the processor in the computer device, when executing the computer readable instructions, further performs the steps of:

if determining that the pixel signal of the pixel block does not meet the first condition, acquiring an average pixel signal of each first grouping unit in the pixel block, where the first grouping unit includes two adjacent unit pixels, and no same unit pixel exists in each of the first grouping units; and acquiring first-type gray-scale signal and second-type gray-scale signal corresponding to the average pixel signal of each first grouping unit by looking up a table.

In one or more embodiments, the processor in the computer device, when executing the computer readable instructions, further performs the steps of:

loading a group of initial high and initial low gray-scale signals to same-color sub-pixels in a first grouping unit of the pixel block, where the first grouping unit includes two adjacent unit pixels, and no same unit pixel exists in each of the first grouping units.

In one or more embodiments, a color signal includes chroma and hue angle, and the red-rendering condition is:

$$0° < H \leq 45° \text{ or } 315° < H \leq 360°, \text{ and } C_{TL1} \leq C \leq C_{TH2}$$

where H is chroma, C is hue angle, $C_{TL1}$ is the lowest predefined red hue threshold value, and $C_{TH2}$ is the highest predefined red hue threshold value.

A computer-readable storage medium has a computer program stored thereon, and the computer program, when executed by a processor, implements the steps of:

S20: acquiring an average pixel signal of sub-pixels of each color in each unit pixel in a pixel block, where the unit pixel includes a red sub-pixel, a green sub-pixel and a blue sub-pixel;

S40: acquiring a color signal of the pixel block according to the average pixel signal of the sub-pixels of each color; and S60: loading first-type gray-scale signals to a part of same-color sub-pixels in the pixel block and loading second-type gray-scale signals to the remaining same-color sub-pixels based on a preset rule according to the color signal and a preset main color-rendering determination condition, where the first-type gray-scale signals are not equal to the corresponding second-type gray-scale signals.

It will be understood by those skilled in the art that all or part of the processes of the method of the embodiments described above may be implemented by instructing relevant hardware through a computer program, which may be stored in a non-volatile computer-readable storage medium, and when executed, may include the processes of the method of the embodiments described above. Any reference to memory, storage, database or other medium used in the embodiments provided herein can include non-volatile and/or volatile memory. Non-volatile memory can include Read-Only Memory (ROM), Programmable ROM (PROM), Electrically Programmable ROM (EPROM), Electrically Erasable Programmable ROM (EEPROM), or flash memory. Volatile memory can include Random Access Memory (RAM) or external cache memory. By way of illustration rather than limitation, RAM is available in a variety of forms such as Static RAM (SRAM), Dynamic RAM (DRAM), Synchronous DRAM (SDRAM), Double Data Rate SDRAM (DDRSDRAM), Enhanced SDRAM (ESDRAM), Synchronous Link (Synchlink), Synchronous Link DRAM (SLDRAM), Rambus Direct RAM (RDRAM), Direct Rambus Dynamic RAM (DRDRAM), and Rambus Dynamic RAM (RDRAM).

The technical features of the embodiments described above can be combined arbitrarily. For the sake of brevity, all possible combinations of the technical features of the above embodiments are not described, and such combinations of the technical features shall be deemed to fall within the scope of the present disclosure as long as there is no contradiction.

The embodiments described above only describe several implementations of the present disclosure, and the description thereof is specific and detailed. However, those cannot be therefore construed as limiting the scope of the present application. It should be noted that, for those of ordinary skill in the art, several variations and modifications can be made without departing from the concept of the present disclosure, which also fall within the scope of the present disclosure. Therefore, the protection scope of the present application shall be defined by the appended claims.

What is claimed is:

1. A pixel driving method, comprising:

acquiring an average pixel signal of sub-pixels of each color in each unit pixel in a pixel block, wherein the unit pixel comprises a red sub-pixel, a green sub-pixel and a blue sub-pixel;

acquiring a color signal of the pixel block according to the average pixel signal of the sub-pixels of each color; and loading first-type gray-scale signals to a part of same-color sub-pixels in the pixel block and loading second-type gray-scale signals to the remaining same-color sub-pixels based on a preset rule according to the color signal and a preset main color-rendering determination condition, wherein the first-type gray-scale signals are not equal to the corresponding second-type gray-scale signals_;

wherein the main color-rendering determination condition comprises a red-rendering condition, and the step of loading the first-type gray-scale signals to the part of same-color sub-pixels in the pixel block and loading the second-type gray-scale signals to the remaining same-color sub-pixels based on the preset rule according to the color signal and the preset main color-rendering determination condition comprises:

if the color signal meets the red-rendering condition, loading the first-type gray-scale signal and the second-type gray-scale signal respectively to two adjacent red sub-pixels of each first grouping unit in the pixel block, wherein the first grouping unit comprises two adjacent unit pixels, and no same unit pixel exists in each of the first grouping units;

and loading the first-type gray-scale signals to three green sub-pixels of each second grouping unit in the pixel block and loading the second-type gray-scale signal to one green sub-pixel in the second grouping unit, wherein the second grouping unit comprises four adjacent unit pixels, and no same unit pixel exists in each of the second grouping units.

2. The pixel driving method according to claim 1, wherein the main color-rendering determination condition comprises a green-rendering condition, and the step of loading the first-type gray-scale signals to the part of same-color sub-pixels in the pixel block and loading the second-type gray-scale signals to the remaining same-color sub-pixels based on the preset rule according to the color signal and the preset main color-rendering determination condition comprises:

if the color signal meets the green-rendering condition, loading the first-type gray-scale signal and the second-type gray-scale signal respectively to two adjacent green sub-pixels of each first grouping unit in the pixel block;

and loading the first-type gray-scale signals to three red sub-pixels of each second grouping unit in the pixel block and loading the second-type gray-scale signal to one red sub-pixel in the second grouping unit.

3. The pixel driving method according to claim 1, wherein the step of loading the first-type gray-scale signals to the part of same-color sub-pixels in the pixel block and loading the second-type gray-scale signals to the remaining same-color sub-pixels based on the preset rule according to the color signal and the preset main color-rendering determination condition comprises:

loading the first-type gray-scale signal and the second-type gray-scale signal respectively to blue sub-pixels of each first grouping unit in the pixel block, wherein the first grouping unit comprises two adjacent unit pixels, and no same unit pixel exists in each of the first grouping units.

4. The pixel driving method according to claim 2, wherein the step of loading the first-type gray-scale signals to the part of same-color sub-pixels in the pixel block and loading the second-type gray-scale signals to the remaining same-color sub-pixels based on the preset rule according to the color signal and the preset main color-rendering determination condition comprises:

loading the first-type gray-scale signal and the second-type gray-scale signal respectively to blue sub-pixels of each first grouping unit in the pixel block, wherein the first grouping unit comprises two adjacent unit pixels, and no same unit pixel exists in each of the first grouping units.

5. The pixel driving method according to claim 1, wherein the main color-rendering determination condition comprises a blue-rendering condition, and the step of loading the first-type gray-scale signals to the part of same-color sub-pixels in the pixel block and loading the second-type gray-scale signals to the remaining same-color sub-pixels based on the preset rule according to the color signal and the preset main color-rendering determination condition comprises:

if the color signal meets the blue-rendering condition, loading the first-type gray-scale signals to three red sub-pixels of each second grouping unit in the pixel block and loading the second-type gray-scale signal to the remaining one red sub-pixel in the second grouping unit;

and loading the first-type gray-scale signals to three green sub-pixels of each of the second grouping units in the pixel block and loading the second-type gray-scale signal to the remaining one green sub-pixel in the second grouping unit.

6. The pixel driving method according to claim 2, wherein the main color-rendering determination condition comprises a blue-rendering condition, and the step of loading the first-type gray-scale signals to the part of same-color sub-pixels in the pixel block and loading the second-type gray-scale signals to the remaining same-color sub-pixels based on the preset rule according to the color signal and the preset main color-rendering determination condition comprises:

if the color signal meets the blue-rendering condition, loading the first-type gray-scale signals to three red sub-pixels of each second grouping unit in the pixel block and loading the second-type gray-scale signal to the remaining one red sub-pixel in the second grouping unit;

and loading the first-type gray-scale signals to three green sub-pixels of each of the second grouping units in the pixel block and loading the second-type gray-scale signal to the remaining one green sub-pixel in the second grouping unit.

7. The pixel driving method according to claim 1, wherein before the step of acquiring the average pixel signal of the sub-pixels of each color in each unit pixel in the pixel block, further comprising:

loading a group of initial high and initial low gray-scale signals to same-color sub-pixels in a first grouping unit of the pixel block, wherein the first grouping unit comprises two adjacent unit pixels, and no same unit pixel exists in each of the first grouping units.

8. The pixel driving method according to claim 1, wherein the color signal comprises chroma and hue angle, and the red-rendering condition is:

$$0° < H \leq 45° \text{ or } 315° < H \leq 360°, \text{ and } C_{TL1} \leq C \leq C_{TH2}$$

wherein the H is chroma, the C is hue angle, the $C_{TL1}$ is the lowest predefined red hue threshold value, and the $C_{TH2}$ is the highest predefined red hue threshold value.

9. A pixel driving apparatus, comprising:

an average signal acquisition circuit configured to acquire an average pixel signal of sub-pixels of each color in each unit pixel in a pixel block, wherein the unit pixel comprises a red sub-pixel, a green sub-pixel and a blue sub-pixel;

a color signal acquisition circuit configured to acquire a color signal of the pixel block according to the average pixel signal of the sub-pixels of each color; and a driving signal loading circuit configured to load first-type gray-scale signals to a part of same-color sub-pixels in the pixel block and loading second-type gray-scale signals to the remaining same-color sub-pixels based on a preset rule according to the color signal and a preset main color-rendering determination condition, wherein the first-type gray-scale signals are not equal to the corresponding second-type gray-scale signals;

wherein the main color-rendering determination condition comprises a red-rendering condition, and the operation of the driving signal loading circuit loading the first-type gray-scale signals to the part of same-color sub-pixels in the pixel block and loading the second-type gray-scale signals to the remaining same-color sub-pixels based on the preset rule according to the color signal and the preset main color-rendering determination condition comprises:

if the color signal meets the red-rendering condition, loading the first-type gray-scale signal and the second-type gray-scale signal respectively to two adjacent red sub-pixels of each first grouping unit in the pixel block, wherein the first grouping unit comprises two adjacent unit pixels, and no same unit pixel exists in each of the first grouping units;

and loading the first-type gray-scale signals to three green sub-pixels of each second grouping unit in the pixel block and loading the second-type gray-scale signal to one green sub-pixel in the second grouping unit, wherein the second grouping unit comprises four adjacent unit pixels, and no same unit pixel exists in each of the second grouping units.

10. A computer device, comprising a non-transitory computer readable memory medium having computer-readable instructions stored therein and one or more processors, wherein the computer-readable instructions, when executed by the one or more processors, cause the one or more processors to perform the steps of:

acquiring an average pixel signal of sub-pixels of each color in each unit pixel in a pixel block, wherein the unit pixel comprises a red sub-pixel, a green sub-pixel and a blue sub-pixel;

acquiring a color signal of the pixel block according to the average pixel signal of the sub-pixels of each color; and loading first-type gray-scale signals to a part of same-color sub-pixels in the pixel block and loading second-type gray-scale signals to the remaining same-color sub-pixels based on a preset rule according to the color signal and a preset main color-rendering determination condition, wherein the first-type gray-scale signals are not equal to the corresponding second-type gray-scale sigmals;

wherein the main color-rendering determination condition comprises a red-rendering condition, and the step of loading the first-type gray-scale signals to the part of same-color sub-pixels in the pixel block and loading the second-type gray-scale signals to the remaining same-color sub-pixels based on the preset rule according to the color signal and the preset main color-rendering determination condition comprises:

if the color signal meets the red-rendering condition, loading the first-type gray-scale signal and the second-type gray-scale signal respectively to two adjacent red sub-pixels of each first grouping unit in the pixel block, wherein the first grouping unit comprises two adjacent unit pixels, and no same unit pixel exists in each of the first grouping units;

and loading the first-type gray-scale signals to three green sub-pixels of each second grouping unit in the pixel block and loading the second-type gray-scale signal to one green sub-pixel in the second grouping unit, wherein the second grouping unit comprises four adjacent unit pixels, and no same unit pixel exists in each of the second grouping units.

11. The computer device according to claim 10, wherein the main color-rendering determination condition further comprises a green-rendering condition, and wherein the processor, when executing the computer readable instructions, further performs the steps of:

if the color signal meets the green-rendering condition, loading the first-type gray-scale signal and the second-type gray-scale signal respectively to two adjacent green sub-pixels of each first grouping unit in the pixel block;

and loading the first-type gray-scale signals to three red sub-pixels of each second grouping unit in the pixel block and loading the second-type gray-scale signal to one red sub-pixel in the second grouping unit.

12. The computer device according to claim 10, wherein the processor, when executing the computer readable instructions, further performs the steps of:

loading the first-type gray-scale signal and the second-type gray-scale signal respectively to blue sub-pixels of each first grouping unit in the pixel block, wherein the first grouping unit comprises two adjacent unit pixels, and no same unit pixel exists in each of the first grouping units.

13. The computer device according to claim 11, wherein the processor, when executing the computer readable instructions, further performs the steps of:

loading the first-type gray-scale signal and the second-type gray-scale signal respectively to blue sub-pixels of each first grouping unit in the pixel block, wherein the first grouping unit comprises two adjacent unit pixels, and no same unit pixel exists in each of the first grouping units.

14. The computer device according to claim 10, wherein the main color-rendering determination condition further comprises a blue-rendering condition, and wherein the processor, when executing the computer readable instructions, further performs the steps of:

if the color signal meets the blue-rendering condition, loading the first-type gray-scale signals to three red sub-pixels of each second grouping unit in the pixel block and loading the second-type gray-scale signal to the remaining one red sub-pixel in the second grouping unit;

and loading the first-type gray-scale signals to three green sub-pixels of each of the second grouping units in the pixel block and loading the second-type gray-scale signal to the remaining one green sub-pixel in the second grouping unit.

15. The computer device according to claim 10, wherein the processor, when executing the computer readable instructions, further performs the steps of:

loading a group of initial high and initial low gray-scale signals to same-color sub-pixels in a first grouping unit of the pixel block, wherein the first grouping unit comprises two adjacent unit pixels, and no same unit pixel exists in each of the first grouping units.

16. The computer device according to claim 10, wherein the color signal comprises chroma and hue angle, and the red-rendering condition is:

$$0° < H \leq 45° \text{ or } 315° < H \leq 360°, \text{ and } C_{TL1} \leq C \leq C_{TH2}$$

wherein the H is chroma, the C is hue angle, the $C_{TL1}$ is the lowest predefined red hue threshold value, and the $C_{TH2}$ is the highest predefined red hue threshold value.

* * * * *